US007950850B2

(12) United States Patent
Fukuizumi

(10) Patent No.: US 7,950,850 B2
(45) Date of Patent: May 31, 2011

(54) LONG PACKAGING MATERIAL FOR MANUFACTURING POUCH

(75) Inventor: Takashi Fukuizumi, Osaka (JP)

(73) Assignee: Fuji Seal International, Inc., Osaka (JP)

( * ) Notice: Subject to any disclaimer, the term of this patent is extended or adjusted under 35 U.S.C. 154(b) by 848 days.

(21) Appl. No.: 10/573,318

(22) PCT Filed: Sep. 24, 2004

(86) PCT No.: PCT/JP2004/013928

§ 371 (c)(1),
(2), (4) Date: Mar. 24, 2006

(87) PCT Pub. No.: WO2005/030595

PCT Pub. Date: Apr. 7, 2005

(65) Prior Publication Data

US 2006/0285775 A1 Dec. 21, 2006

(30) Foreign Application Priority Data

Sep. 26, 2003 (JP) ..... 2003-334612

(51) Int. Cl.
*B65D 30/00* (2006.01)
*B65D 30/20* (2006.01)

(52) U.S. Cl. ..... 383/37; 383/120; 383/907

(58) Field of Classification Search ..... 383/37, 383/104, 120, 907; 53/452, 455, 456, 558, 53/562

See application file for complete search history.

(56) References Cited

U.S. PATENT DOCUMENTS

| | | | | | |
|---|---|---|---|---|---|
| 2,990,101 | A * | 6/1961 | Mead et al. | 383/35 |
| 3,186,625 | A * | 6/1965 | Mcad et al. | 383/37 |
| 5,944,251 | A * | 8/1999 | LaFleur | 229/117.35 |
| 6,126,315 | A * | 10/2000 | Ichikawa et al. | 383/43 |
| 6,193,416 | B1 * | 2/2001 | Kawamata et al. | 383/104 |
| 2003/0202719 | A1 * | 10/2003 | Wilkes | 383/120 |

FOREIGN PATENT DOCUMENTS

| | | | |
|---|---|---|---|
| DE | 29719686 | | 1/1998 |
| EP | 1 142 798 | | 10/2001 |
| JP | 06122457 | A * | 5/1994 |
| JP | 06179454 | A * | 6/1994 |
| JP | 09300486 | A * | 11/1997 |
| JP | 10-202768 | | 8/1998 |
| JP | 11105892 | A * | 4/1999 |
| JP | 11147547 | A * | 6/1999 |
| JP | 11208676 | A * | 8/1999 |
| JP | 2001048193 | A * | 2/2001 |
| JP | 2001-97437 | | 4/2001 |
| JP | 2001-348040 | | 12/2001 |
| JP | 2003146337 | A * | 5/2003 |
| JP | 2004359333 | A * | 12/2004 |

* cited by examiner

*Primary Examiner* — Jes F Pascua
(74) *Attorney, Agent, or Firm* — Hamre, Schumann, Mueller & Larson, P.C.

(57) ABSTRACT

An elongated packaging material (A1) for manufacturing a pouch comprises a first elongated flexible sheet (10), and a second elongated flexible sheet (10) layered on the first sheet. The side ends of the first and the second sheets are provided with a plurality of side sealing portions (2) extending lengthwise of the sheets. A plurality of cross sealing portions (3) are spaced from each other lengthwise of the sheets. Each of the side sealing portions is provided with a plurality of projecting portions (20), each projecting toward a center of the width of the sheets, between an adjacent pair of cross sealing portions.

5 Claims, 11 Drawing Sheets

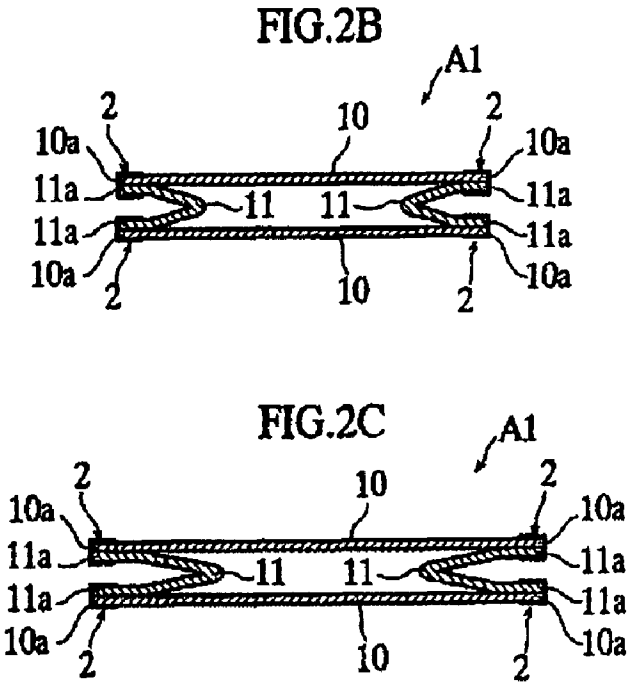
FIG.2B
A1
2
10a
11a
11a
10a
2
10
11
11
10
2
10a
11a
11a
10a
2
FIG.2C
A1
2
10a
11a
11a
10a
2
10
11
11
10
2
10a
11a
11a
10a
2
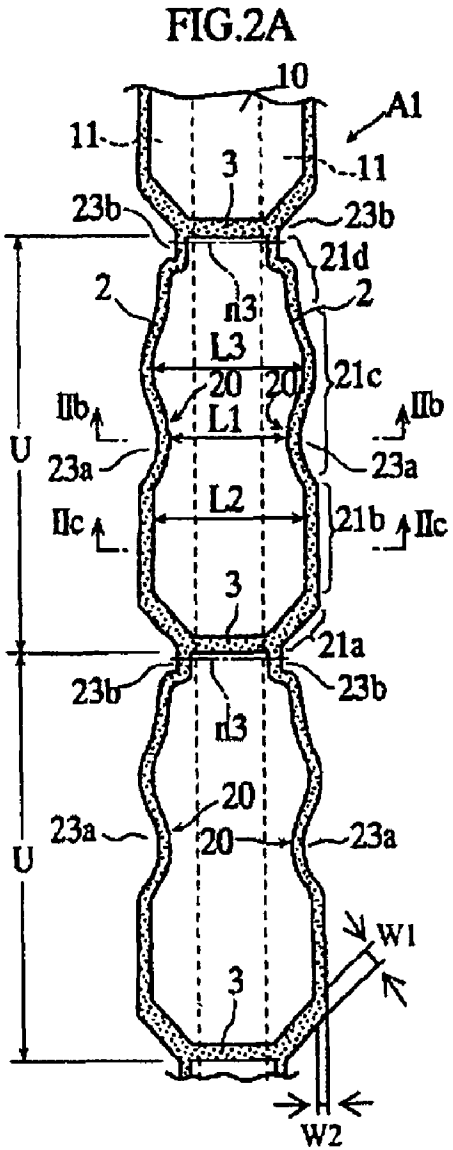
FIG.2A
A1
10
11
23b
21d
2
21c
IIb
23a
21b
IIc
21a
23b
23a
W1
W2
3
r3
L3
20
L1
L2
3
r3
20
20
3
11
23b
2
IIb
23a
IIc
23b
23a
U
U

LONG PACKAGING MATERIAL FOR MANUFACTURING POUCH

TECHNICAL FIELD

The present invention relates to an elongated packaging material for manufacturing pouch for containing a beverage or a jelly-type food, for example.

BACKGROUND ART

Examples of pouches for containing a beverage include various conventional pouches. Specifically, a pouch with a spout is disclosed in the following patent document 1 or 2.

Patent Document 1: JP-A-H10-202768

Patent Document 2: JP-A-2001-9744437

As shown in FIG. 11, a conventional pouch with a spout includes a pouch body made of a pair of flexible sheets 7 and also includes a spout 51 inserted into the pouch body. A reference character 70A indicates a heat sealing portion formed at the side ends and the bottom of the pouch body. A reference character 70B indicates a heat sealing portion formed at the top of the pouch body. By forming the heat sealing portion 70B, an opening at the top of the pouch body is closed and the spout 51 is fixed to the pouch body.

In the above-described pouch, e.g. product name is printed on the surface of the sheet 7, so that the pouch may be distinguishable from other products. However, many of the conventional pouches are made of a pair of sheets with linearly elongated sides, as shown in FIG. 11. Thus, in spite of contrivance in designs of the printing on the sheets, the designs of various products tend to be uniform. Further, because of the similar forms, distinction from other products cannot be made adequately.

A solution to this problem may be forming the pouch as shown in FIG. 9. The illustrated pouch P includes sheets 8 each formed with recesses 80 at the side ends, so that the sheet 8 has a narrow portion at the intermediate part in the vertical direction. The pouch P with such a form can be easily distinguished from the pouch shown in FIG. 11, thereby favorably improving the product distinction.

The above-described pouch P can be manufactured by a following method. First, a pouch body P' as shown in FIG. 10 is made. Specifically, a pair of sheets 8 is prepared, and a pair of gussets is placed between the sheets. In this state, the side ends and the bottom of each sheet 8 are sealed by heat into a predetermined form (see heat sealing portion 81). Then, the sheets 80 (and the gussets) are cut to form the recesses 80, whereby the pouch body P' is obtained. After making the pouch body P', a spout 51 is attached to the pouch body P' and a content (e.g. beverage) is poured into the pouch body P'. Finally, a cap 52 is attached to the spout 51 and then the upper ends of the pair of sheets 8 are sealed by heat. In this way, the pouch P shown in FIG. 9 is obtained.

Typically, manufacturers produce a plurality of pouches successively. In this case, a plurality of pouch bodies P' are made in advance and prepared, and thereafter, transferred for the process to attach a spout, one by one. This transfer can be automatically performed by a proper supplying mechanism. Specifically, a system is made so that the plurality of pouch bodies P' are set in a predetermined supplying magazine, and then a belt conveyor transfers the pouch bodies P' for the attaching process of the spout, one by one. However, such manufacturing method causes following problems.

First, each pouch body P' includes an opening at its top. Thus, in storage or transfer of the pouch body P', dust may come into a pouch body P' through the opening.

Second, it is not always easy to accurately set a plurality of flexible pouch bodies P' to the supplying magazine. Further, it is not a very efficient operation to accurately pick out pouch bodies P' one by one from the set position for transferring each of them to the next process. Thus, the above-described manufacturing method of pouches is less speedy and unsuitable for improving productivity. Further, the system for such manufacturing method is complicated and thus the cost is expensive.

Third, when transferring a pouch body P' by the conveyor, the pouch body P' may change its posture due to vibration of the transfer machine. As the pouch body P' has a narrow portion at the intermediate part in the height, it is difficult to properly guide its sides. If the posture of the pouch body P' is not stable during transfer, the operation at the next process may not be performed properly.

DISCLOSURE OF THE INVENTION

The present invention has been proposed under the above-described circumstances. It is therefore an object of the present invention to provide an art for efficiently and sanitarily manufacturing pouches having a narrow portion.

To solve the above problem, the present invention provides the following technical method.

A long packaging material for manufacturing a pouch according to the present invention comprises a first elongated flexible sheet, a second elongated flexible sheet layered on the first sheet, a plurality of side sealing portions provided at side ends of each of the first and second sheets, the side sealing portions extending lengthwise of the first and second sheets, and a plurality of cross sealing portions spaced from each other lengthwise of the sheets. Each of the side sealing portions is provided with a plurality of projecting portions, each of the projecting portions projecting toward a center of width of the first and second sheets, between an adjacent pair of the cross sealing portions.

According to the present invention, the long packaging material is cut into the sets, each including a pair of sheets, so that a plurality of pouch bodies (or pouches made of the pouch bodies) are successively manufactured. Each of the pouch bodies includes side ends sealed by the side sealing portions, a bottom sealed by the cross sealing portion, and an opening at its top. As each of the side sealing portions is provided with a projecting portion projecting toward the center of the width of the sheet, the outside of the projecting portion can be cut out, widthwise thereof, to form a recess. Thus, each of the pouch bodies is provided with an arrow portion, widthwise thereof, and the narrow portion is properly sealed. In this way, the long packaging material according to the present invention can be used to properly manufacture a plurality of pouch bodies (or pouches) each having a peculiar form, which is the object of the invention. Further, in the present invention, following effect can be obtained.

First, in the long packaging material for manufacturing pouch according to the present invention, the pair of sheets are hermetically sealed until the above-described cutting operation is performed. Therefore, dust or damp air may not come into the long packaging material in transfer or storage, and thus its inside is kept clean.

Second, in manufacturing pouches by cutting the long packaging material for manufacturing pouch according to the present invention, the long packaging material is rolled in advance, for example, successively pulled out from the roll to be transferred through a predetermined transfer path, and cut at a predetermined position. At this cutting position, a plurality of pouch bodies are made and supplied one by one. The pouch bodies are immediately transferred for the next process one by one, so that desired products containing e.g. beverage can be manufactured quickly. This manufacturing method can reduce the cost, as there is no need to use a complicated machine, in which, for example, a plurality of the pouch bodies are piled up and accurately pulled out one by one.

Third, when transferring the long packaging material to the cutting position, its posture during the transfer can be stable, differing from transferring the single pouch body. As described above, it is difficult to guide the single pouch body having an arrow portion widthwise thereof, in transferring one by one, and its position may be disadvantageously changed. However, in the present invention, even if the long packaging material is formed with a plurality of narrow portions, portions other than the narrow portions can be guided to prevent the long packaging material from snaking, to be properly transferred.

Fourth, in the present invention, the long packaging material is strengthened and thus prevented from being warped or wrinkled during transfer. Specifically, as the projecting portions, provided at the side sealing portions, project toward the center of the width of the sheets, the sheets are strengthened to be rigid. At the projecting portions of the side sealing portion, the sheets are partly layered and contacting to each other, and thus stiffer and more rigid than other portions of the sheets other than the sealing portions, thereby obtaining the above effect. Therefore, in the present invention, when manufacturing pouches by pulling out the long packaging material from the roll, the transfer process can be facilitated. Further, without the warp and wrinkle, labeling or printing process can be performed efficiently on the transfer path.

Preferably, each of the first and second sheets is formed with recesses, outside of the projecting portions, widthwise of the sheet. Due to this structure, a pouch body can be formed with a narrow portion, widthwise thereof, by only cutting the sheets widthwise, which facilitates the manufacturing operation. Further, by forming a plurality of cutouts or recesses at the sheets, entire weight of the long packaging material can be reduced, and thus the distribution cost is reduced.

Preferably, a width of the side sealing portion is larger at a portion formed with the projecting portion than at other portions of the side sealing portion without the projecting portion. Due to this structure, necessary information for in manufacturing (e.g. marker for positioning the sheets) may be indicated by printing on the projecting portions. Of course, the projecting portions are partly cut to form recesses afterward, so that the above information is deleted.

BRIEF DESCRIPTION OF THE DRAWINGS

FIG. 2A is a plan view illustrating a principal part of the long packaging material shown in FIG. 1. FIG. 2B is a sectional view taken along lines IIb-IIb of FIG. 2A, and FIG. 2C is a sectional view taken along lines IIc-IIc of FIG. 2A.

BEST MODE FOR CARRYING OUT THE INVENTION

Figure 1:
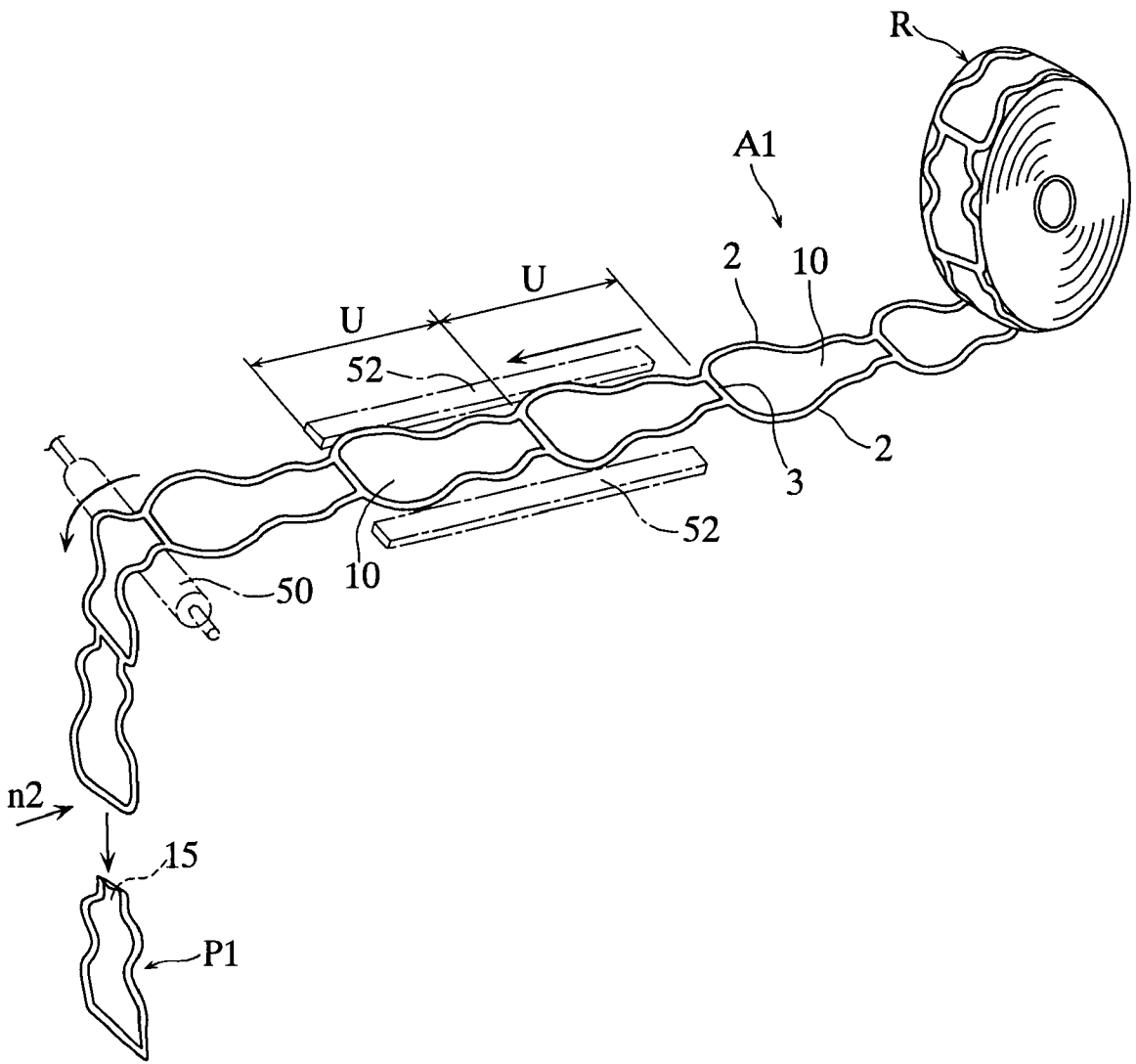
FIG. 1 is a perspective view illustrating a long packaging material for manufacturing pouches, according to a first embodiment of the present invention.

Preferred embodiments of the present invention are specifically described below with reference to the accompanying drawings.

FIGS. 1 and 2A-2C illustrate a long packaging material for manufacturing pouch according to a first embodiment of the present invention. As shown in FIGS. 2B and 2C, a long packaging material A1 includes a pair of sheets 10 and a pair of gussets 11 provided between the sheets. The two sheets 10 are connected to each other via the two gussets 11. Connecting portions (side sealing portions) of the sheets 10 and the gussets 11 are indicated by a reference number 2. A reference number 3 in FIGS. 1 and 2A indicates cross sealing portions.

The pair of sheets 10 are elongated in a same direction and laminated on each other in the thicknesswise direction. Each gusset 11 is bent into a V-shape in section, and elongated in the same direction as the sheets 10 are elongated. Each of the sheets 10 and the gussets 11 may be a laminated film made by laminating one or more layers of resin film on surfaces of an aluminum film. A resin film of the laminated film that serves as the outermost layer of the long packaging material A1 is a printable film made of polyethylene terephthalate, for example. The innermost resin film is made of e.g. polyethylene film that may be sealed by heat.

At each of the side sealing portions 2, a side end 10*a* of the sheet 10 and a side end 11*a* of the gusset 11 are laminated on each other and sealed by heat. The long packaging material A1 includes four side sealing portions. As shown in FIG. 2A, each of the cross sealing portions 3 is formed into a line extending, between each two of the side sealing portions 2, widthwise of the long packaging material A1. The cross sealing portions 3 are spaced from each other, at a predetermined distance, lengthwise of the long packaging material A1. At each of the cross sealing portions 3, a pair of sheets 10 and a pair of gussets 11 are flatly laminated on each other and sealed by heat. Thus, the long packaging material A1 includes a plurality of hermetically sealed unit pouched areas U, each provided between each two of the cross sealing portions 3. In other words, the long packaging material A1 is a string of the unit pouched areas U aligned in a predetermined direction. The long packaging material A1 is symmetrical with respect to the center line of its width.

Each of the side sealing portions 2 is formed into a bent or curved line having a proper width, and includes a plurality of projecting portions 20. Specifically, the side sealing portion 2 is a string of sets each including an inclined portion 21*a*, a linear portion 21*b*, a curved portion 21*c* and a subsidiary portion 21*d*. The inclined portion 21*a* includes an end connected to the cross sealing portion 3 and is inclined relative to the length and width of the long packaging material A1. The linear portion 21*b* is connected to the inclined portion 21*a* and is elongated lengthwise of the long packaging material A1. The curved portion 21*c* is connected to the linear portion 21*b* and is curved into an S-shape. The subsidiary portion 21*d* is connected to the curved portion 21*c* and is elongated to the adjacent cross sealing portion 3. The projecting portion 20 is a part of the curved portion 21*c* and projects toward the center of the width of the sheet 10. The inner width (minimum width) L1 between each two projecting portions 20 is smaller than the inner width L2 between each two linear portions 21*b* and than the inner width L3 between each two curved portions 21*c* except the projecting portions. The sealing width W2 of the side sealing portion 2 is substantially constant except at the inclined portion 21*a* which has a larger sealing width W1 The inclined portion 21*a* requires high strength as it is placed in the vicinity of the bottom of a pouch made of the long packaging material A1. Therefore, the width of the side sealing portion 2 is larger at the inclined portion 21*a* than at the other portions.

Each of the sheets 10 and the gussets 11 has an outer configuration corresponding to that of the side sealing portions 2, so that there is no portion protruding widthwise beyond the side sealing portion 2. In this structure, a cutout or a recess 23*a* is formed, outside of each of the projecting portion 20, widthwise of the long packaging material A1. Similarly, a cutout or a recess 23*b* is formed outside of the inclined portion 21*a* and the subsidiary portion 21*d*.

Figure 3A:
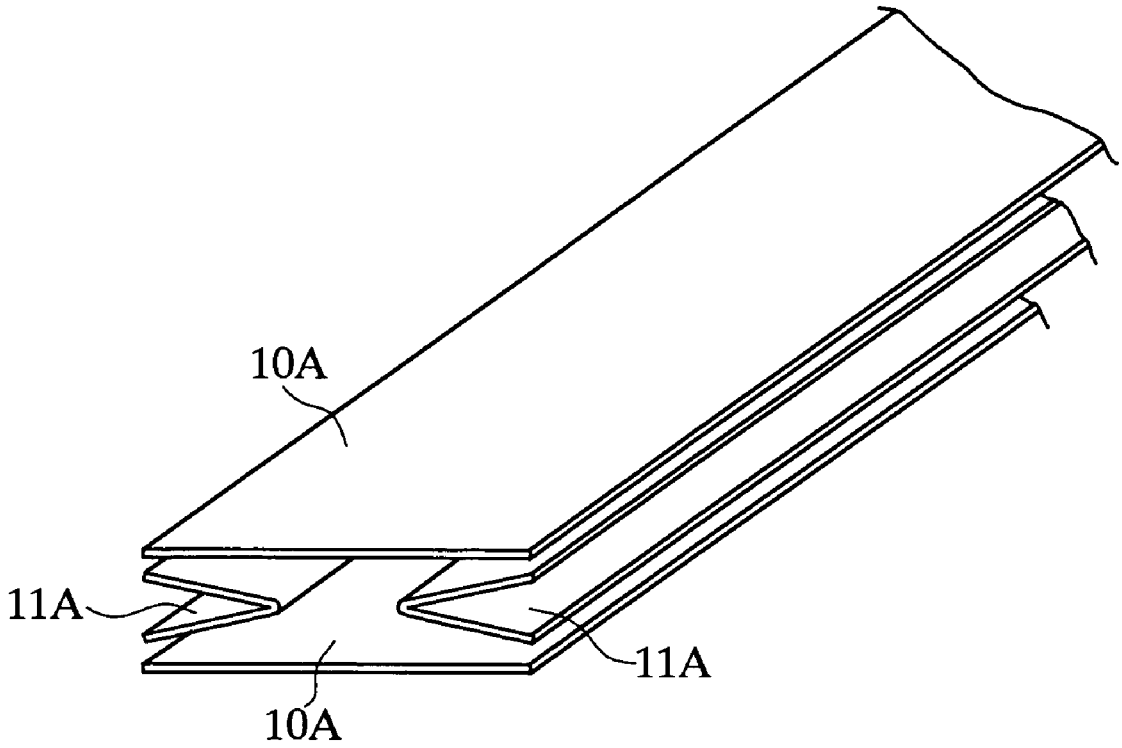
FIGS. 3A and 3B are perspective views illustrating a forming process of the long packaging material shown in FIG. 1.

As shown in FIG. 3A, the long packaging material A1 can be made of two strip-shaped sheet materials 10A each having a predetermined width and two sheet materials 11A folded in half. Specifically, the two sheet materials 11A are placed between the two sheet materials 10A. Next, these sheet materials are sealed to form the side sealing portions 2 and the cross sealing portions 3. In sealing, use is made of a sealing device that includes a heating member having a form corresponding to the side sealing portions 2 and the cross sealing portion 3 of the above described unit pouched area U (see FIG. 2A). The heating member is repeatedly pressed against the sheet materials 10A, 11A to successively form side sealing portions 2 and cross sealing portion 3, lengthwise of the sheet materials 10A, 11A. After the heat sealing, the sheet materials 10A, 11A are cut along the outline of the side sealing portions 2 shown in FIG. 2A. In cutting, use may be made of a Thomson blade or a dicing cutter.

Figure 3B:
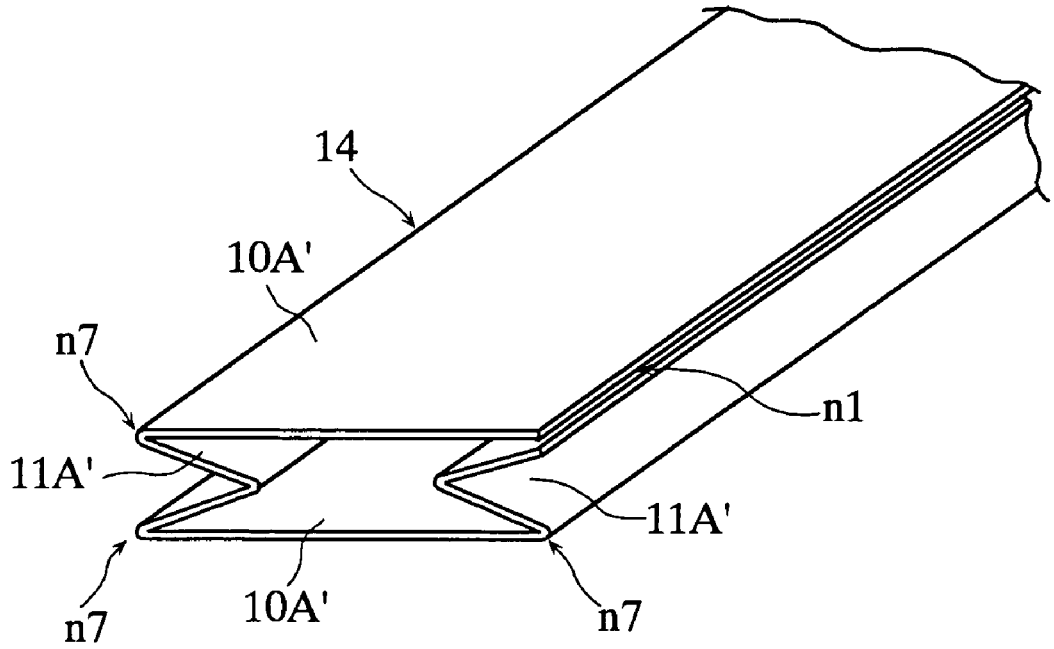

In the present invention, as shown in FIG. 3B, one sheet material 14 may be used to make the long packaging material similarly to the one shown in FIG. 3A. Specifically, the sheet material 14 is folded to form a pair of sheet portions 10A' and a pair of gusset portions 11A'. In this case, the heat sealing is applied only to a portion of the sheet 14 indicated by a reference character n1. Preferably, an additional portion indicated by a reference character n7 (a connecting portion of the sheet portions 10A' and the gusset portions 11A') is sealed by heat. This improves the strength of the portion n7 and also improves the appearance.

Next, an example of use and the function of the above-described long packaging material A1 are described.

The long packaging material A1 is rolled up in transfer or in storage. As shown in FIG. 1, in making a pouch having a spout, a roll R of the long packaging material A1 is set at a predetermined portion of a manufacturing device (not shown), and the long packaging material A1 is successively pulled out of the roll R. The long packaging material A1 is transferred through a predetermined path toward a roller 50, for example, and after passing over the roller 50, transferred downwardly. In the downward transfer path, the long packaging material A1 is cut by a cutting device (not shown) at a portion indicated by an arrow n2, thereby manufacturing a pouch body P1. Specifically, the long packaging material A1 is cut at the portions indicated by an imaginary line n3 in FIG. 2A. The pouch body P1 has a form corresponding to that of the above-described unit pouched areas U. An edge of the cut portion forms an opening 15, and thus the top of the pouch body P1 is provided with the opening 15.

Figure 4:
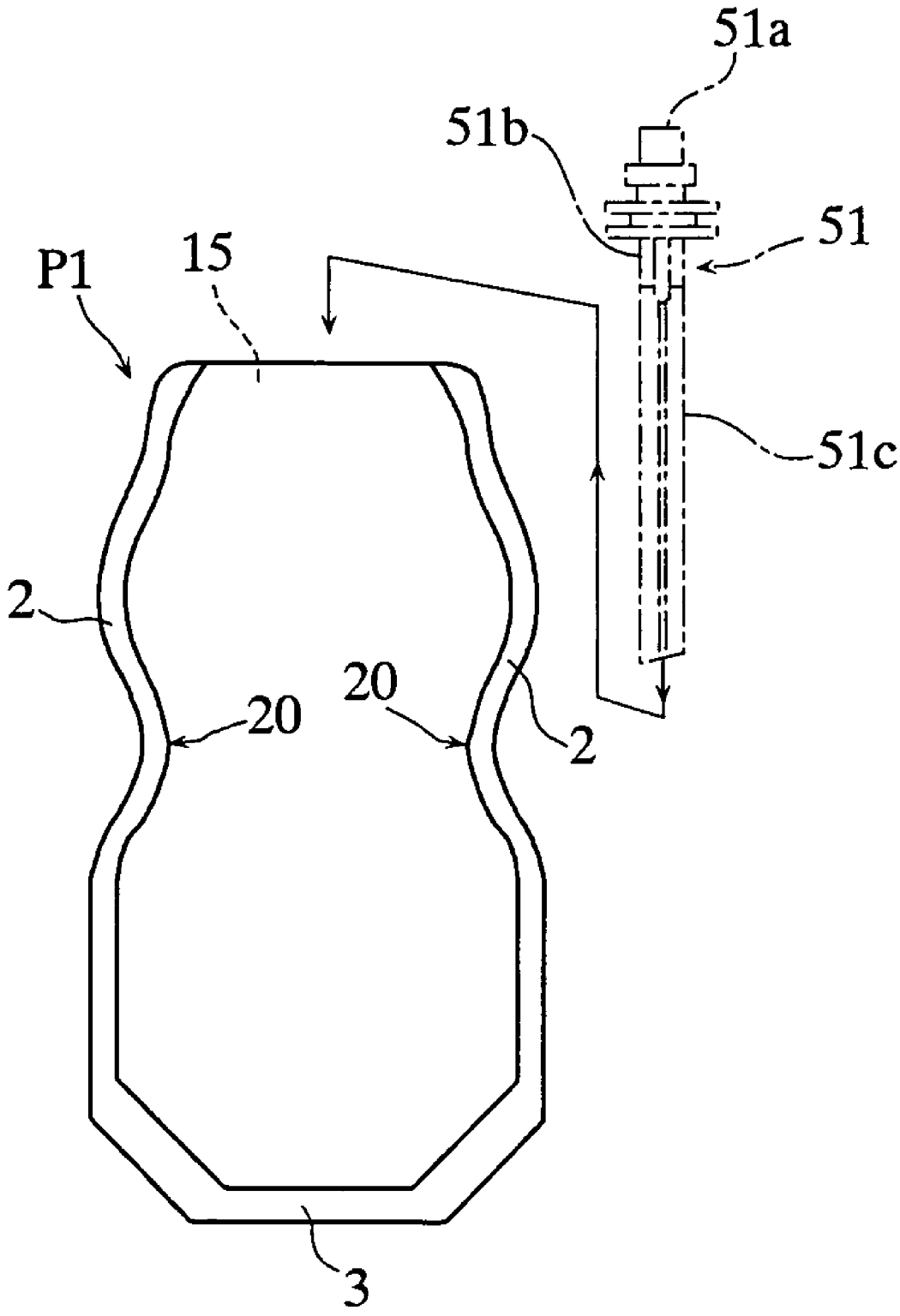
FIG. 4 is a front view illustrating a pouch body made of the long packaging material shown in FIG. 1.
Figure 9:
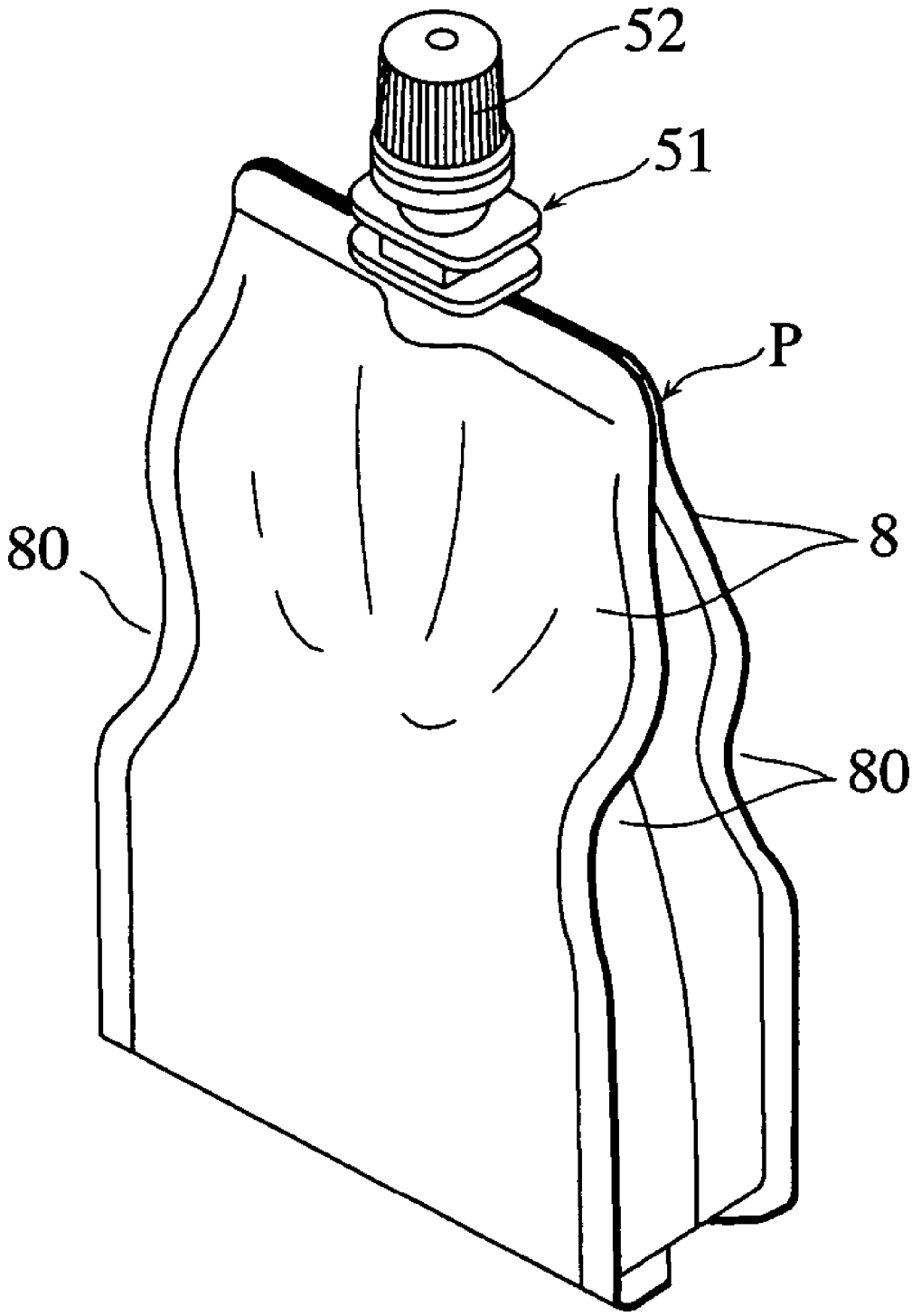
FIG. 9 is a perspective view illustrating a pouch as a reference example.
Figure 10:
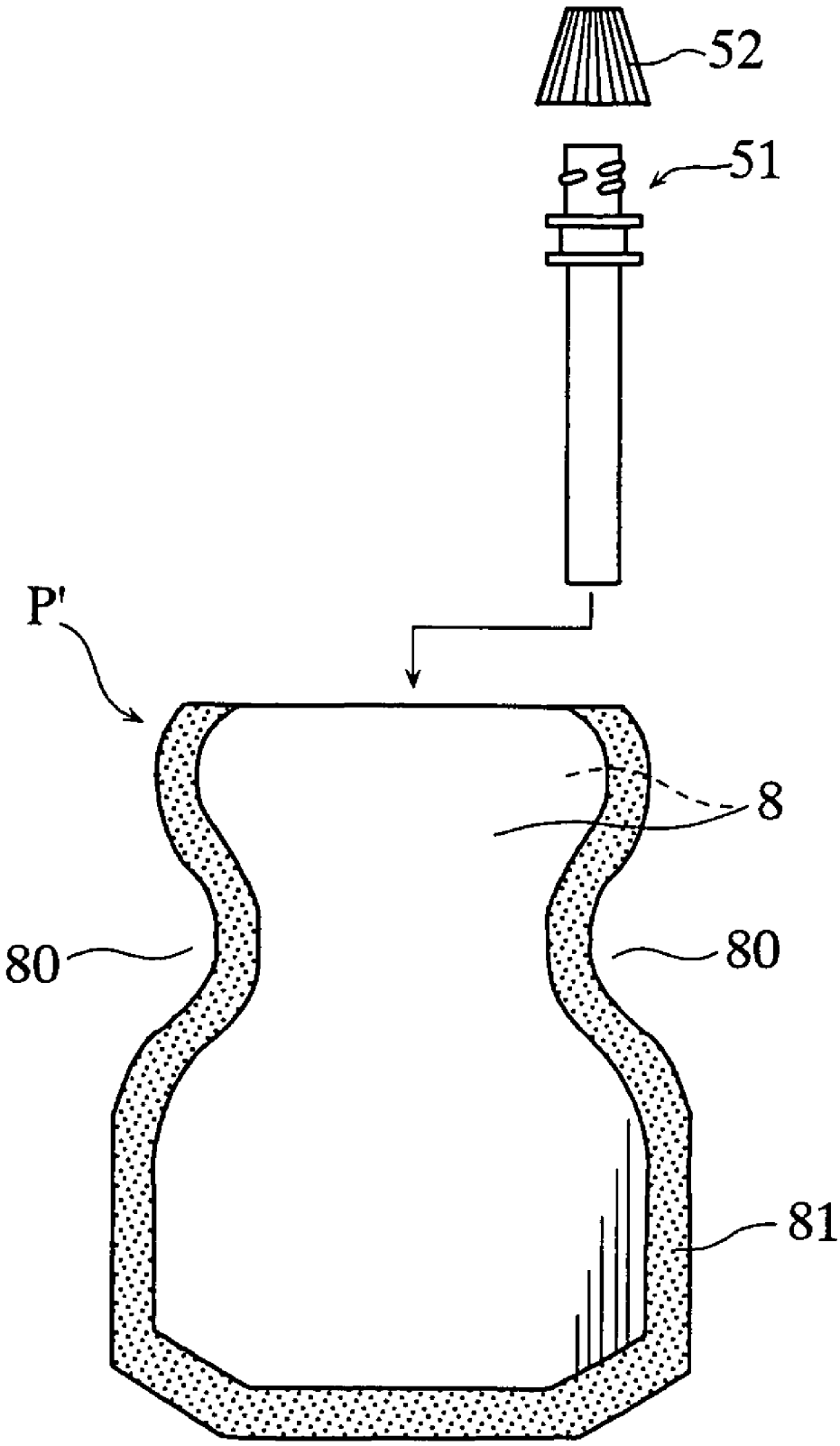
FIG. 10 is a view illustrating a method of manufacturing the pouch shown in FIG. 9.
Figure 11:
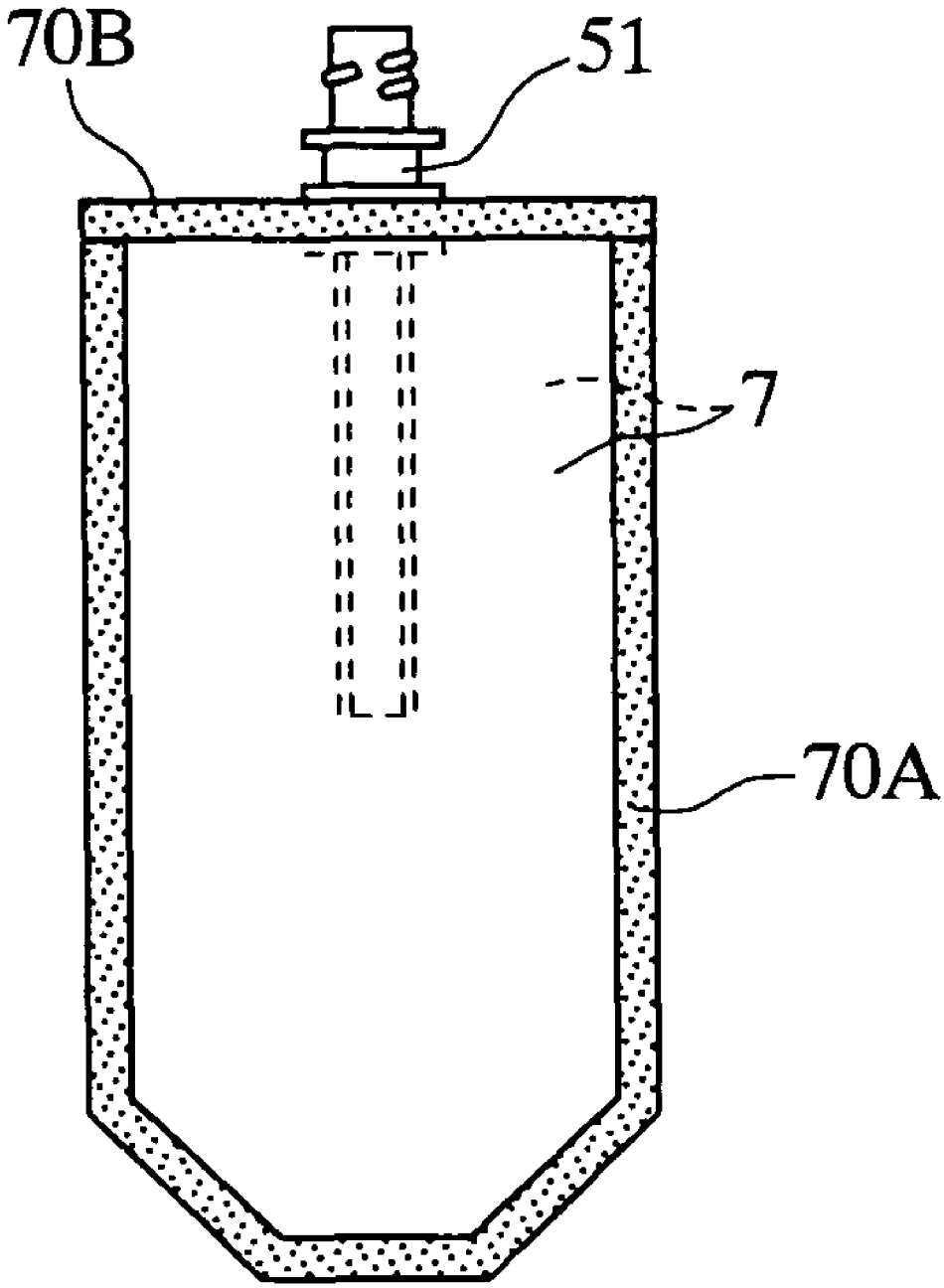
FIG.11 PRIOR ART
FIG. 11 is a front view illustrating a conventional pouch.

Next, the pouch body P1 is held by a proper holder (not shown) and is transferred to a position for the next process where, as shown in FIG. 4, a spout 51 is inserted into the opening 15. The spout 51 includes a mouth 51*a*, a fixing portion 51*b*, and a rod 51*c*. The mouth 51*a* serves as an inlet or an outlet for a beverage. The fixing portion 51*b* is attached to the pouch body P1 by heat sealing. The rod 51*c* is inserted into the pouch body P1. After the insertion of the rod 51*c*, the upper portion of the pouch body P1 is sealed by heat, whereby the opening 15 is closed and the spout 51 is fixed to the pouch body P1. Thereafter, the pouch body P1 is filled with a beverage through the spout 51, and then the spout 51 is provided with a cap. In this way, a pouch as described above with reference to FIG. 9 is obtained.

The pouch body P1, or the pouch as an end product, is formed with the recess 23*a* at its each side, and thus has a narrow portion at the intermediate part in the height. Due to this structure, a grip on the narrow portion facilitates hold of the pouch, and also prevents the pouch from slipping off the hand. Further, as the pouch has a peculiar form with the narrow portion, consumers can easily distinguish the pouch from other goods.

The long packaging material A1 is hermetically sealed until it is cut into the pouch bodies P1. Thus, dust or damp air does not come into the inside of the long packaging material A1 in handling. If the inside of the long packaging material A1 is sterilized, the sterile condition may be properly maintained sanitarily.

In the above-described manufacturing process of the pouch body P1, the long packaging material A1 is required not to snake through the transfer path, for being properly cut at desired portions. In view of this, as illustrated by imaginary lines in FIG. 1, a guide member 52 may be provided at each side of the transfer path of the long packaging material A1, so that the pair of guide members 52 guide the both sides of the string of unit pouched areas U. Though the width of the long packaging material A1 is not constant, the maximum width of the unit pouched areas U is constant. The guide members 52 simultaneously guide a plurality of portions having the maximum width, so that the long packaging material A1 can be properly prevented from snaking.

When the long packaging material A1 is pulled out of the roll R and is transferred, the long packaging material A1 may desirably prevented from being warped or wrinkled. In the long packaging material A1, the projecting portions 20 of the side sealing portions 2 serve to reinforce the long packaging material A1. Specifically, the projecting portions 20 of the side sealing portions 2 are stiffer and more rigid than the other portions of the sheets 10 without heat sealing. Thus, if the projecting portions 20 are placed near the intermediate part in the width of the sheets 10, the long packaging material is entirely strengthened, comparing with the case where the projecting portions 20 are not provided at the side sealing portions 2.

As described above, if the long packaging material A1 is strengthened by the existence of the plurality of projecting portions 20, the long packaging material A1 is prevented from being warped or wrinkled. It is difficult to properly remove a warp or a wrinkle generated widthwise of the long packaging material A1, even if a pull tension is applied lengthwise of the long packaging material A1 during transfer. However, in the present embodiment, as each of the projecting portions 20 widthwise occupies a predetermined dimension in the sheet 10, the long packaging material A1 is properly prevented from being warped or wrinkled widthwise thereof. Therefore, the long packaging material A1 may be prevented from getting, due to the warp or wrinkle, hung up on devices existing along the transfer path. Further, labeling or printing process can be performed efficiently. Still further, when the long packaging material A1 has cut portion recognition markers, the markers may be prevented from not being detected due to the warp or wrinkle.

The pouch body P1 has, as described above, a peculiar form with a narrow portion at the intermediate part in the height, and each of the unit pouched areas U of the long packaging material A1 has a form similar to the pouch body P1. Therefore, the plurality of pouch bodies P1 can be easily obtained by only cutting the long packaging material A1 at linear cutting lines. Further, as the long packaging material A1 is formed with the cutouts or the recesses 23*a*, the weight of the long packaging material A1 is less than in the case without such recesses, whereby the distribution cost can be reduced.

Figure 5A:
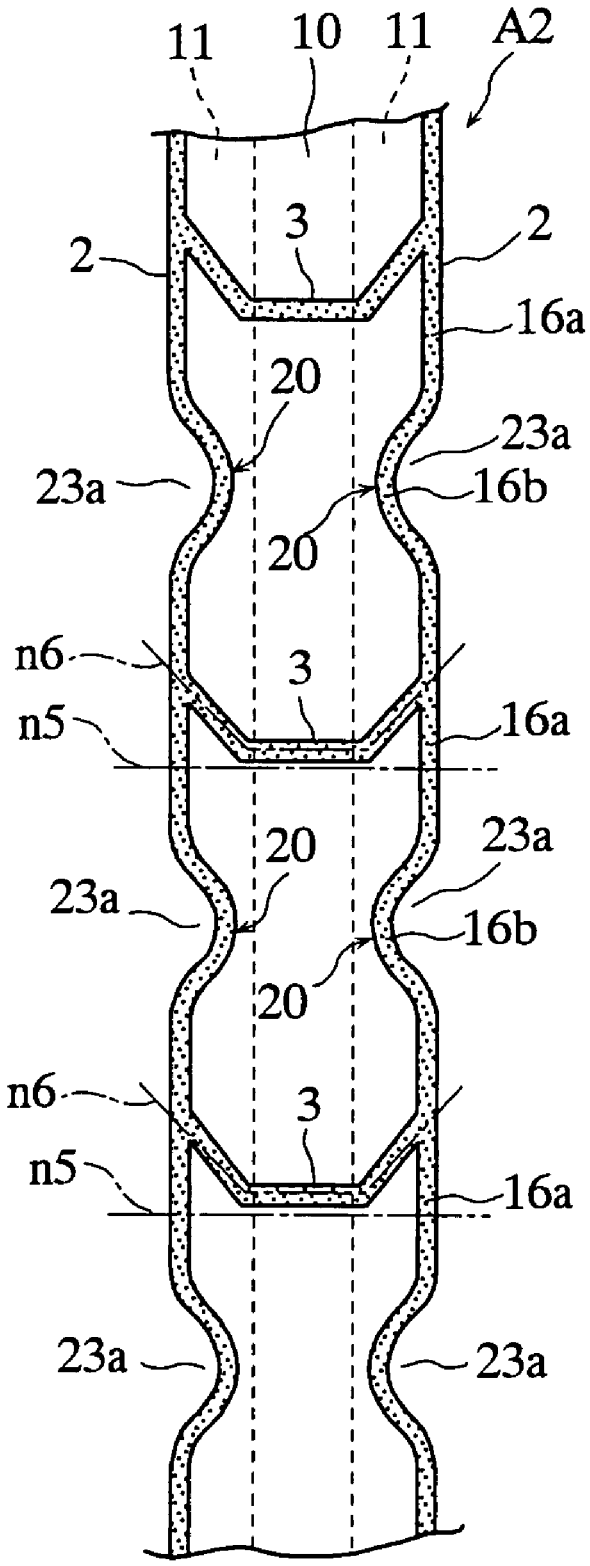
FIG. 5A is a front view illustrating a long packaging material for manufacturing pouches, according to a second embodiment of the present invention.
Figure 5B:
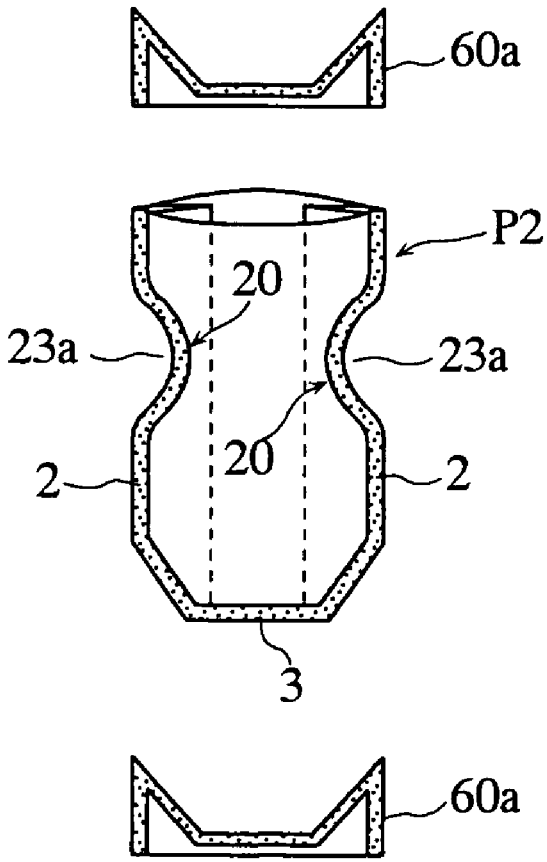
FIG. 5B is a view illustrating a cutting process of the long packaging material shown in FIG. 5A.
Figure 6A:
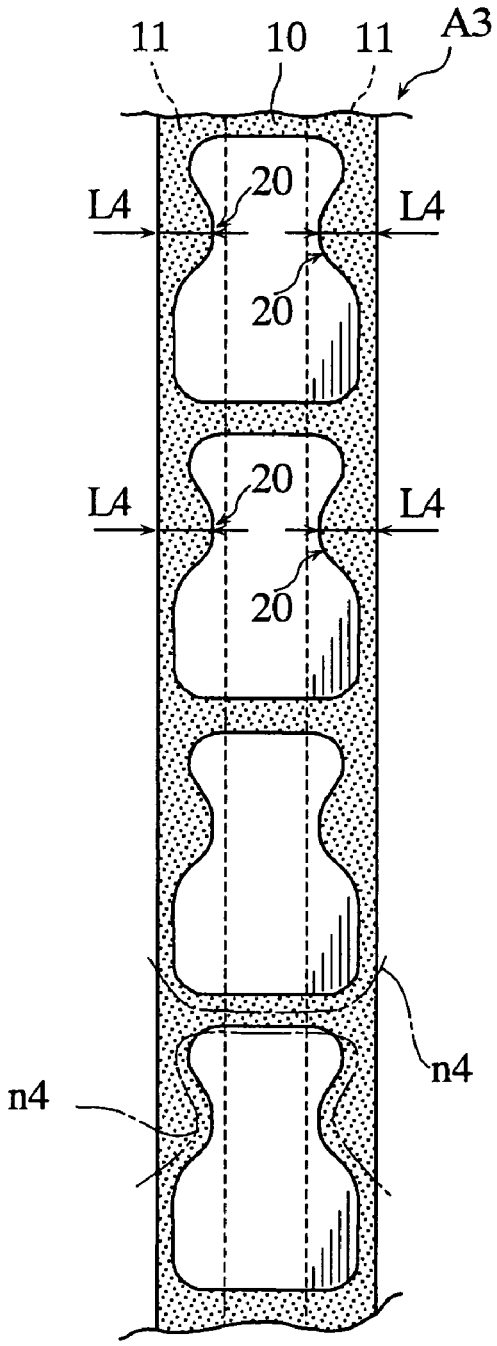
FIG. 6A is a front view illustrating a long packaging material for manufacturing pouches, according to a third embodiment of the present invention.
Figure 6B:
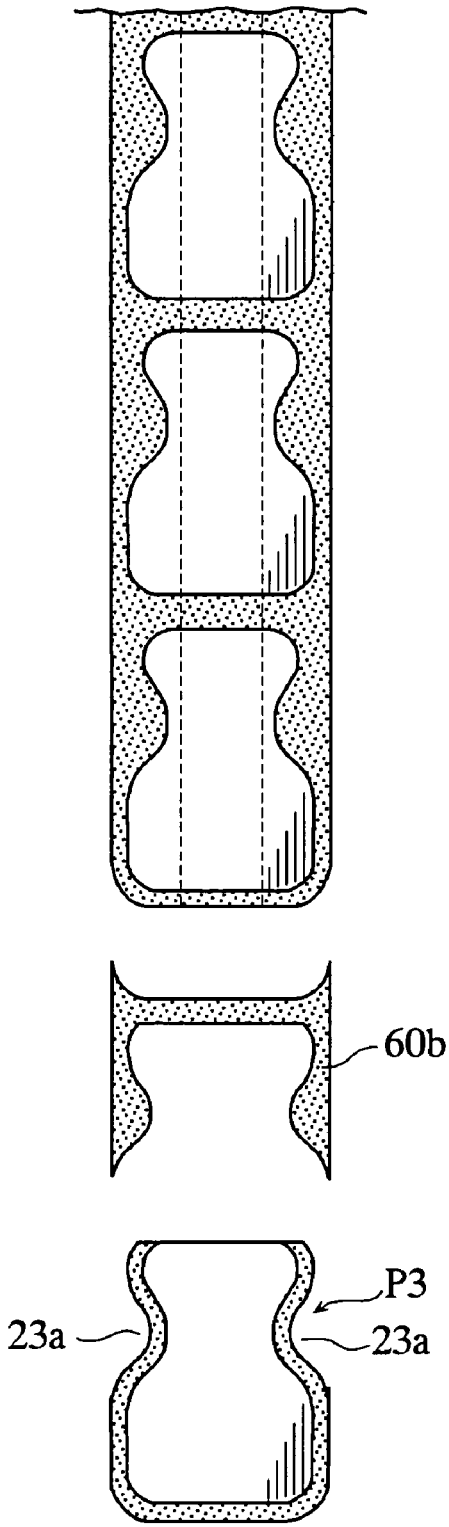
FIG. 6B is a view illustrating a cutting process of the long packaging material shown in FIG. 6B.

FIGS. 5A and 5B illustrate a second embodiment of the present invention, and FIGS. 6A and 6B illustrate a third embodiment of the present invention. In these figures, elements identical or similar to those in the above-described first embodiment are given the same reference numbers.

As shown in FIG. 5A, along packaging material A2 according to the second embodiment includes side sealing portions 2, each having a plurality of linear portions 16*a* and curved portions 16*b* alternately aligned lengthwise of the long packaging material A2. The curved portions 16*b* form projecting portions 20 projecting toward the center of the width of the long packaging material A2. Each of the cross sealing portions 3 is linearly elongated widthwise of the long packaging material A2, and includes bent ends each connected to a respective one of the side sealing portions 2. The sheets 10 and the gussets 11 are formed with cutouts or recesses 23*a*, outside and widthwise of the projecting portions 20. Thus, the sheets 10 and the gussets 11 are formed with narrow portions, and have a constant width except at the narrow portions.

As shown in FIG. 5B, when the long packaging material A2 is cut at the portions indicated by reference numbers n5, n6, extra pieces 60*a* are obtained in addition to pouch bodies P2 each having an opening at its top. In this way, the long packaging material A2 is also favorable for efficiently manufacturing pouches, each having a peculiar form with a narrow portion at the intermediate part in the height. Further, similarly to the long packaging material A1, the long packaging material A2 can be transferred stably, and is also strengthened by the existence of the plurality of projecting portions 20, thereby being prevented from being warped or wrinkled. The linear portions 16*a* of the side sealing portions 2 may be curved portions, and the cut portions may be changed according to the form of the sealing portions.

As shown in FIG. 6A, a long packaging material A3 is not formed with any cutout or recess at the side ends of the sheets 10 and the gussets 11, and has a constant width. Each of the projecting portions 20 of the side sealing portions 2 is not formed into a curved line with a substantially constant width, but has a sealing portion partially with a large width L4.

When the long packaging material A3 is cut at portions indicated by imaginary lines n4 in FIG. 6A, extra pieces 60*b* as shown in FIG. 6B are obtained in addition to pouch bodies P3 each having an opening at its top. Similarly to the above-described pouch bodies P1, P2, each of the pouch bodies P3 has a form with a narrow portion at the intermediate part in the height. In the long packaging material A3, the width of the sealing portions is larger at the projecting portions 20 than at the other sealing portions. Thus, the long packaging material A3 has strength larger than the long packaging materials A1, A2, thereby efficiently prevented from being warped or wrinkled. Further, information necessary for manufacturing the pouch body P3 may be indicated by printing on the projecting portions 20. As shown in FIG. 6B, on manufacturing the pouch body P3, each of the projecting portions 20 is partly cut and removed so that the above information is not known to the consumer of the pouch body 3, and that the appearance may be good.

As seen from these embodiments, the projecting portions of the side sealing portion of the present invention may be provided by forming a curved side sealing portion with a constant width, or by forming a side sealing portion with a partly large width. When cutouts or recesses are formed outside of the projecting portions of the sheets, a cutting form of the long packaging material is simplified, and the weight of the long packaging material is reduced.

The present invention is not limited to the above-described embodiments. The specific structure of the long packaging material for manufacturing pouch according to the present invention may be modified in various ways.

Figure 7A:
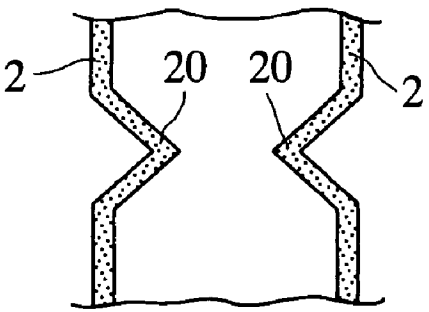
FIGS. 7A-7D are front views, each illustrating a form of a narrow portion at side sealing portions.
Figure 7B:
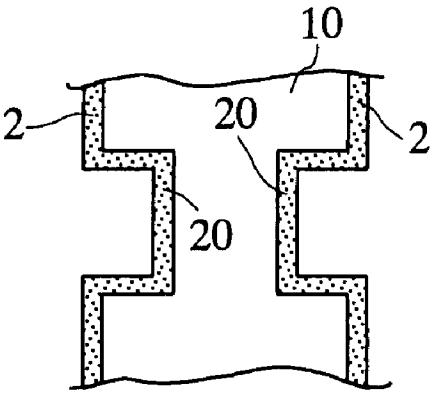
Figure 7C:
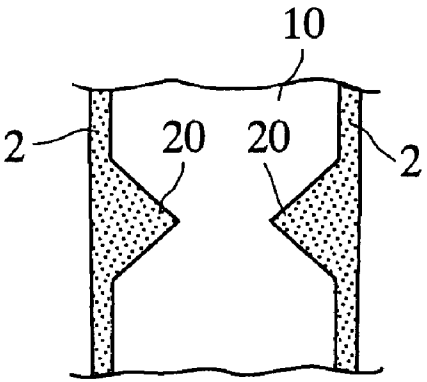
Figure 7D:
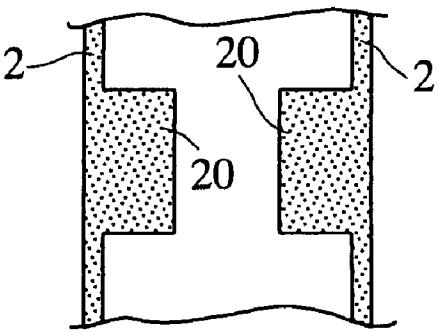

Each of the projecting portions of the side sealing portions may not have an outline with a smooth curve. For example, as shown in FIG. 7A or 7B, each of the projecting portions 20 of the side sealing portions 2 may have an outline with straight lines. Further, in such structure, the sealing portion may have a large width (area) at the projecting portions, as shown in FIGS. 7C, 7D.

Figure 8:
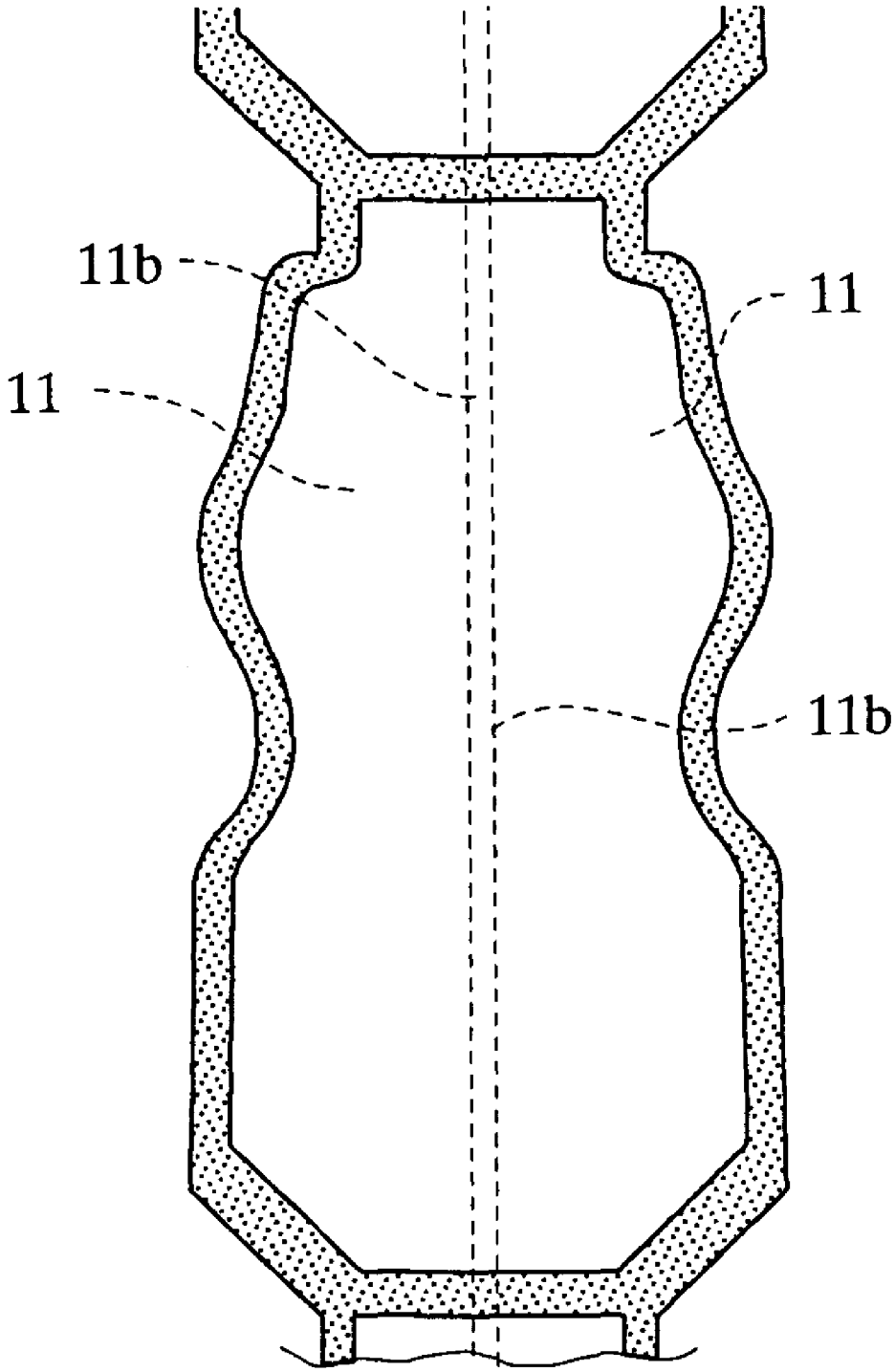
FIG. 8 is a plan view illustrating a modified example of the long packaging material shown in FIG. 2A.

The gussets serve to enlarge the capacity of the pouch, or to enlarge the bottom of the pouch so that the pouch stands stably. As shown in FIG. 8, a bent portion 11*b* of each of the gussets 11 may be arranged in the vicinity of the center of the sheets 10. With such an arrangement, when the pouch is filled with contents, the horizontal section of the pouch is square. In the present invention, the gusset may not be provided. In this case, the pair of sheets are directly layered on each other at the side ends to be sealed.

The material of the sheets is not limited, either. In the present invention, the laminate film including an aluminum film may be replaced with a film made of other material.

The long packaging material for manufacturing pouch according to the present invention is not limited by a specific structure of a pouch as an end product that is manufactured using the long packaging material, or by a specific method for manufacturing the pouch. Further, the pouch may be formed without the spout. The pouch may be filled with a solid other than liquid or jelly.

The invention claimed is:

1. A roll of an elongated packaging material for manufacturing a plurality of pouches, comprising a series of unit pouch areas corresponding to the plurality of pouches and connected serially to each other along a length of the packaging material, the series of unit pouch areas comprising:

a first elongated flexible sheet;

a second elongated flexible sheet layered on the first sheet;

a plurality of side sealing portions provided at side ends of each of the first and second sheets, the side sealing portions extending lengthwise of the first and second sheets; and a plurality of cross sealing portions spaced from each other lengthwise of the sheets, each two adjacent cross sealing portions defining therebetween a respective one of the unit pouch areas;

wherein each of the side sealing portions is provided with a plurality of projecting portions before each unit pouch area is paid out from the roll, each of the projecting portions projecting toward a center of width of the first and second sheets, between an adjacent pair of the cross sealing portions;

wherein each of the first and second elongated flexible sheets includes a first wider width portion between each said projecting portion and a first of the adjacent cross sealing portions, a narrower width portion at each said projecting portion, and a second wider width portion between each said projecting portion and a second of the adjacent cross sealing portions, before the unit pouch area is paid out from the roll;

wherein each of the side sealing portions includes an inclined portion for connection to an adjacent cross sealing portion before the unit pouch area is paid out from the roll; and wherein each of the first wider width portion and the second wider portion has a wider inner width than the narrower width portion before the unit pouch are is paid out from the roll.

2. The roll according to claim 1, wherein each of the first and second sheets is formed with recesses, outside of the projecting portions, widthwise of the sheet.

3. The roll according to claim 1, wherein each of the cross sealing portions is shorter than the inner width of the first wider width portion.

4. The roll according to claim 1, wherein each of the side sealing portions in each unit pouch area includes a subsidiary portion connected to the inclined portion of said each side sealing portion in an adjacent unit pouch area.

5. The roll according to claim 4, wherein the subsidiary portion of said each side sealing portion is connected to the inclined portion of said each side sealing portion at a boundary between the inclined portion and an adjacent cross sealing portion, a recess being formed outside of the subsidiary portion.

* * * * *